United States Patent [19]

Buck

[11] 4,406,449

[45] Sep. 27, 1983

[54] APPARATUS FOR DEPOSITING SHEETS IN A STACK

[75] Inventor: Hermann Buck, Hülben, Fed. Rep. of Germany

[73] Assignee: Bielomatik Leuze GmbH & Co., Neuffen, Fed. Rep. of Germany

[21] Appl. No.: 265,915

[22] Filed: May 21, 1981

[30] Foreign Application Priority Data

Jun. 24, 1980 [DE] Fed. Rep. of Germany ..... 3023533

[51] Int. Cl.[3] ..... B65H 29/34; B65H 31/26

[52] U.S. Cl. ..... 271/189; 271/218; 271/220

[58] Field of Search ..... 271/220, 223, 224, 189, 271/218

[56] References Cited

U.S. PATENT DOCUMENTS 2,904,335 9/1959 Rabinow ..... 271/224 X 4,221,378 9/1980 Kamath et al ..... 271/220

4,260,148 4/1981 Diesch ..... 271/220 X 4,297,066 10/1981 Ramcke ..... 271/218 X

FOREIGN PATENT DOCUMENTS 1126176 3/1962 Fed. Rep. of Germany ..... 271/220

2804672 8/1978 Fed. Rep. of Germany ..... 271/224

*Primary Examiner*—Richard A. Schacher

*Attorney, Agent, or Firm*—Steele, Gould & Fried

[57] ABSTRACT

An apparatus for depositing sheets in a stack. The advancing edges of the sheets are brought to a halt by abutting stops. Hold down devices located in the region of the stops restrict the rising up of the advancing edges of the sheets against the stops. The hold down devices comprise rough or adhering surfaces on the stops and/or flexible and/or pivotal elements arranged above and extending obliquely over the stack in the direction of sheet advance.

23 Claims, 6 Drawing Figures

APPARATUS FOR DEPOSITING SHEETS IN A STACK

BACKGROUND OF THE INVENTION

The present invention relates to an apparatus for depositing sheets in a stack.

In such a stacking apparatus, two different types of stops are provided at the edge of the stack situated downstream of the stack in the direction of transport of the sheets. Such stops which move away from the edge of the stack as the stack forms, have been disclosed in German Auslegeschrift No. 1 303 445. In this arrangement, one stop has a support surface which is capable of supporting the stack at least at its front region so that the stack can be pulled out by means of a gripper beneath this support surface while a new stack is being formed above it.

This apparatus functions perfectly satisfactorily with comparatively heavy paper and up to certain operating speeds but if the speeds are high and the paper is light, the downstream or forward edges of these sheets are liable to lift up at the stop, particularly when they reach the support surface of the upper stop, resulting in the formation of an untidy stack.

German Auslegeschrift No. 1 187 636 discloses an apparatus by means of which a gap can be formed in a stream of separate sheets. The stream of sheets is slowed down and directed obliquely upwards as a closely staggered heap. Guide bands are provided to determine the outline of the interrupted rows of sheets. These bands, which are fairly flexible, lie over the streams of sheets.

SUMMARY OF THE INVENTION

It is an object of the present invention to provide an apparatus which reliably prevents the rising up of the forward or downstream edges of the sheets as viewed in the direction of sheet transport.

According to the present invention there is provided an apparatus for depositing sheets in a stack, in which each sheet is conveyed over a stacking location and brought to a halt by at least one stop co-operating with the advancing forward edge of the sheets, the improvement consisting of the provision of hold down means arranged in the region of of said at least one stop and which co-operates with the forward edge of the sheets to restrict rising up of said forward edge against said at least one stop.

In one preferred embodiment of the invention, the hold down means is arranged on the stop means and preferably has a rough or adhering surface. This surface which may, for example, be ridged, co-operates with the forward edges of the sheets, as viewed in the direction of transport, to prevent their rising upwards at the stop. In another preferred embodiment, the hold down means consists of at least one flexible element located above and extending obliquely over the stack in the direction of transport of the sheets. Preferably, this element is a springy, flexible strip of material such as, for example, a metal strip. The element is capable of yielding to the introduction of sheets transported to the stack and thus travels upwards with the stack but reliably prevents the forward edges of individual sheets from rising up. In addition, it firmly guides the sheets over the entire forward region of the stack and prevents upward bending of the sheets when they are braked by the stop.

In another embodiment comprising two stops which alternately swing inwards and outwards, it is particularly advantageous to provide both stops with a roughened or ridged surface as well as providing two different types of flexible hold down elements. One of these elements may be longer than the stack and may, for example, pass through openings in the upper stops but be limited in its movement in the direction towards the stack by them so that it is put out of action when an upper stop is deflected out of position. Its function is then taken over by a shorter flexible hold down element which is approximately as long as the stack and ends in front of the lower stop.

Both types of hold down device ensure good to perfect operation of the stacking apparatus, particularly if they are both used at the same time.

BRIEF DESCRIPTION OF THE DRAWINGS

Embodiments of the present invention will now be described, by way of example, with reference to the accompanying drawings, in which.

DETAILED DESCRIPTION OF THE PREFERRED EMBODIMENTS

Figure 1:
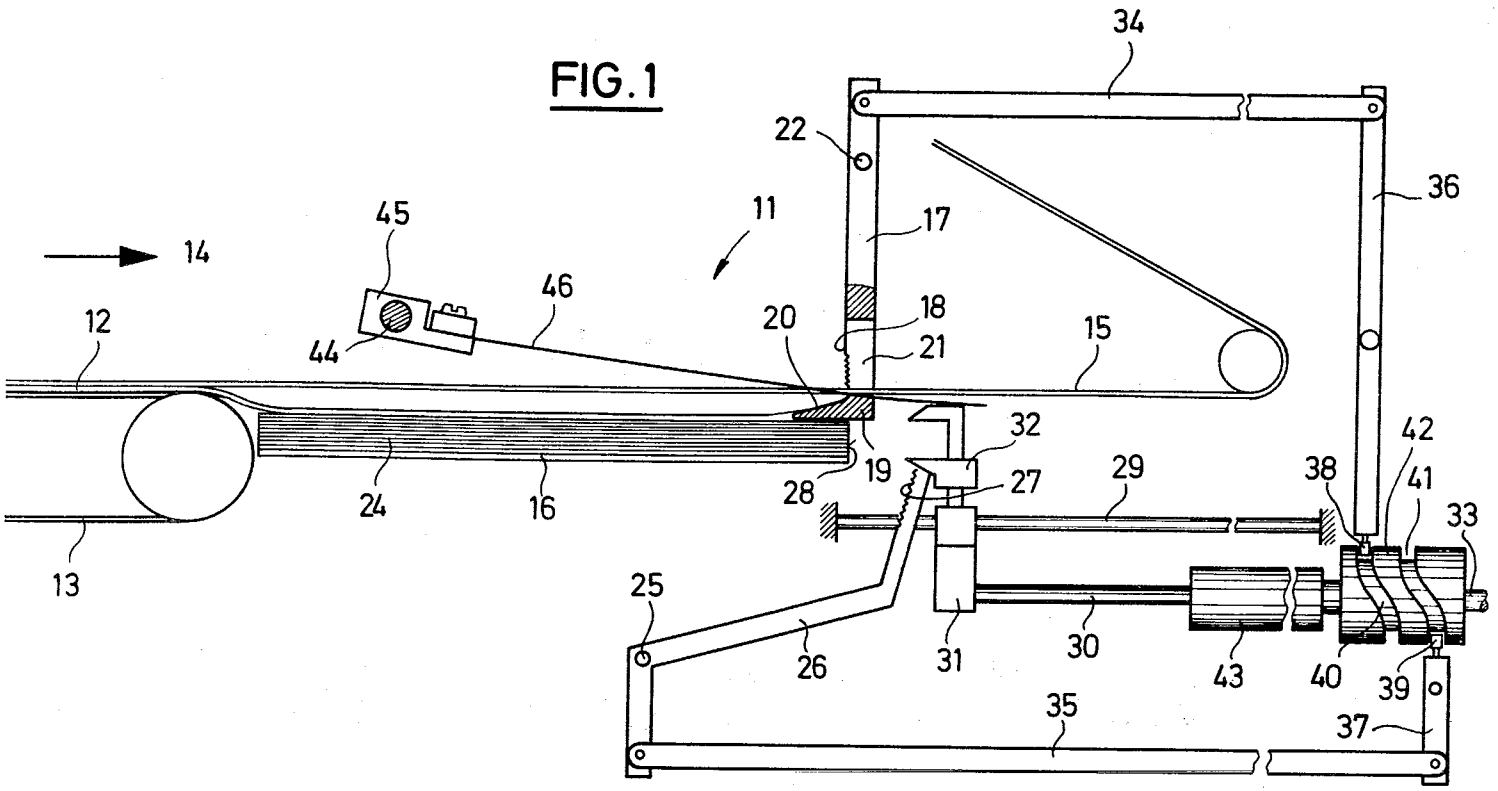
FIGS. 1 and 3 are schematic side views of a stacking apparatus in three different operating positions.

A stacking apparatus 11 is shown in FIG. 1. The stacking apparatus 11 including a drive system, is normally the final member of a paper processing machine in which rolls of paper are cut up into sheets, sorted and overlapped one above the other. A stream of overlapping sheets 12 is carried in the transport direction 14 on a delivery conveyor provided by conveyor belts 13. Upper bands 15 which guide the stream of sheets extend over the conveyor belts 13 and the adjacent stacking apparatus 11.

The stacking apparatus comprises a substantially horizontal stacking table 16 the rear boundary of which is formed by two stop groups each comprising a plurality of stops. Upper stops 17 are provided (two in this example) which have a substantially vertical stop surface 18 and a lower foot 19 with oblique support surface 20. The foot 19 extends into the stack in the direction opposite the transport direction 14 of the stack. In the region of the stop surface 18, i.e. above the foot, the upper stop 17 has an opening provided by a vertical slot 21 (see FIG. 6). The upper stop 17 is designed to pivot about a horizontal pivot 22 above the stack and consists of a two-armed lever.

Figure 6:
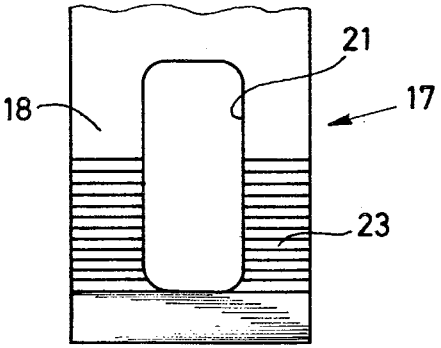
FIG. 6 is a view of the detail of FIG. 5 seen from the left.
Figure 5:
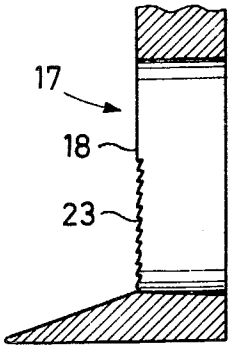
FIG. 5 is a section through a detail of an upper stop.
Figure 4:
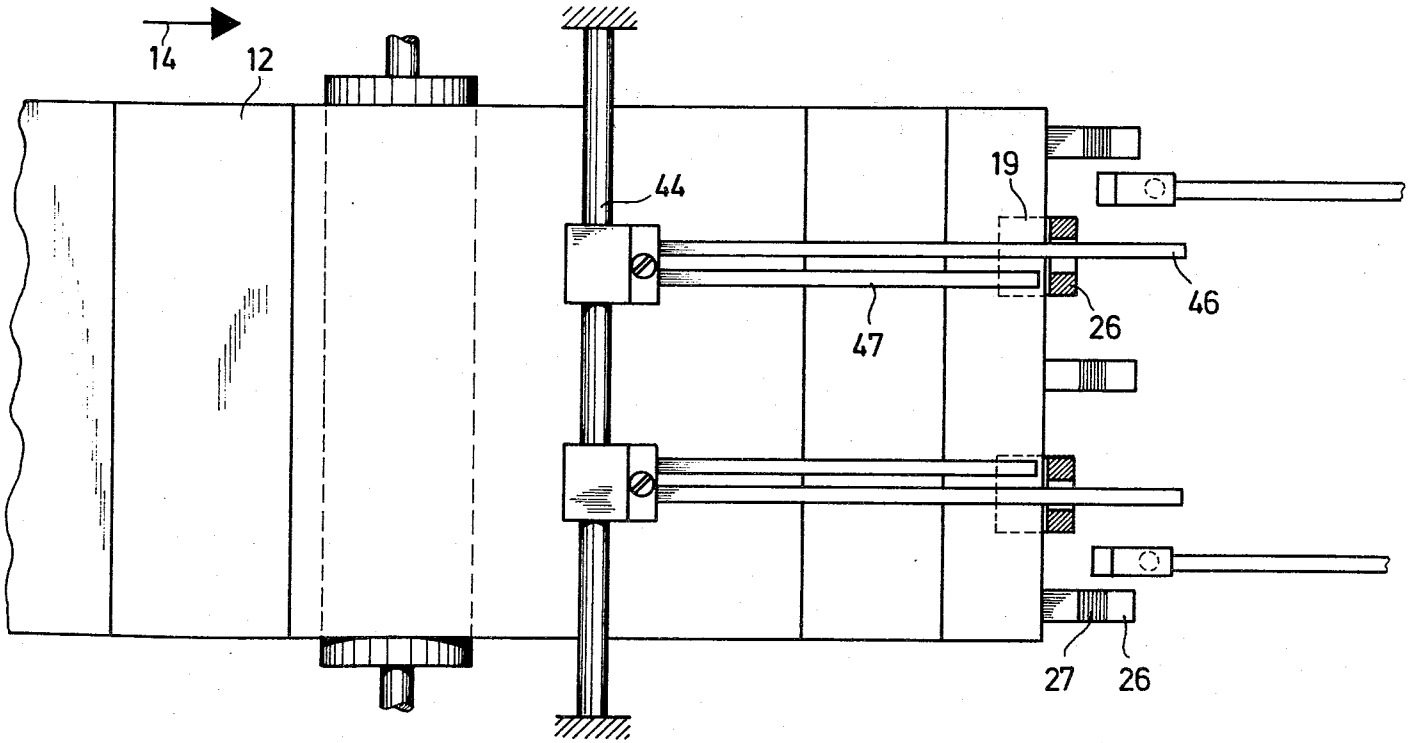
FIG. 4 is a top plan view of such a stacking apparatus.

In the region of its stop surface 18, i.e. at the edge of the stop 17 facing the stack, the stop 17 has a corrugation provided by horizontally directed teeth 23, shown in FIGS. 5 and 6. These teeth 23 are preferably in the form of sawteeth and are directed so that they block mainly in the upward direction, i.e. the upper sides are oblique while the lower side of each tooth is approximately horizontal.

A lower stop 26 also in the form of a two-armed lever is mounted so as to pivot about a horizontal pivot 25 located below the stack 24. A stop surface 27 of this stop 26 also has ridges in the form of sawteeth, which block mainly in the upward direction. Both stops can be pivoted to a position in which they provide the stop for the forward edges 28 of the sheets and of the stack formed by the sheets.

Grippers 32 in the form of tongs are provided, which have the usual type of closing mechanism and are operated in the usual manner and are therefore not shown in detail. These grippers 32 are arranged so that they are capable of gripping a stack of sheets 24 on the stacking table and pulling this stack out horizontally in the direction of transport 14. In the example illustrated, their movement mechanism is represented by a guide rod 29 and a piston rod 30. The piston rod 30 is mounted on a mounting block 31 for the gripper, which in turn is supported on the guide rod 29. The piston rod 30 is horizontally displaceable by a pneumatic cylinder 43 operating in dependence on the rotation of a synchronous shaft 33.

The drive mechanisms for the two stops 17, 26 and the grippers 32 are operated from the common synchronous shaft 33 which also drives conveyor belts 13, 15 by way of chains or sprocket belts. For this purpose, the stops 17, 26 are each connected by way of connecting rods 34, 35 to one end of two double-armed levers 36, 37 which have guide rollers 38, 39 at their other ends, which run in curved guide grooves 40, 41 of a cam drum 42 mounted on the synchronous shaft 33. The operation of the gripper 32 is controlled by the pneumatic cylinder 43 coupling the piston rod 30 and the synchronous shaft 33.

A pair of differing hold down devices 46, 47 in the form of springy, flexible metal bands is mounted on blocks 45 extending in the transport direction 14 from an attachment rod 44 which extends horizontally above the stack. One type of these metal bands extends beyond the end of the stack and passes through the opening 21 in the upper stop 17. The other hold down device 47 extends only as far as the end of the stack and may lie either between the stops 17, 26 or on the foot 19 of the upper stop 17. The hold down devices 46, 47 extend approximately from the front third of the stack to the end of the stack at a shallow angle and may be lightly pressed against the stack by adjusting the blocks 45 on the rod 44 so that they describe a shallow curve in this direction.

The operation of the apparatus described is as follows:

In the position shown in FIG. 1, a stack 24 has already been formed and the stop 17 has been swung with its foot 19 into the stack by way of the cam 40, lever 36 and rod 34 so that the sheets 12 which now follow are deflected upwards by the oblique support surface 20. The ends of these sheets are prevented from rising up the stop, by means of the hold down device 46 which extends through the opening 21 and is under slight tension in the region of the foot 19 at the bottom of this opening 21 and also by the ridges 23 on the stop surface 18. As already mentioned, it is sufficient in many cases, to provide only one of these two measures, for example only a ridged surface or only the hold down device.

Figure 2:
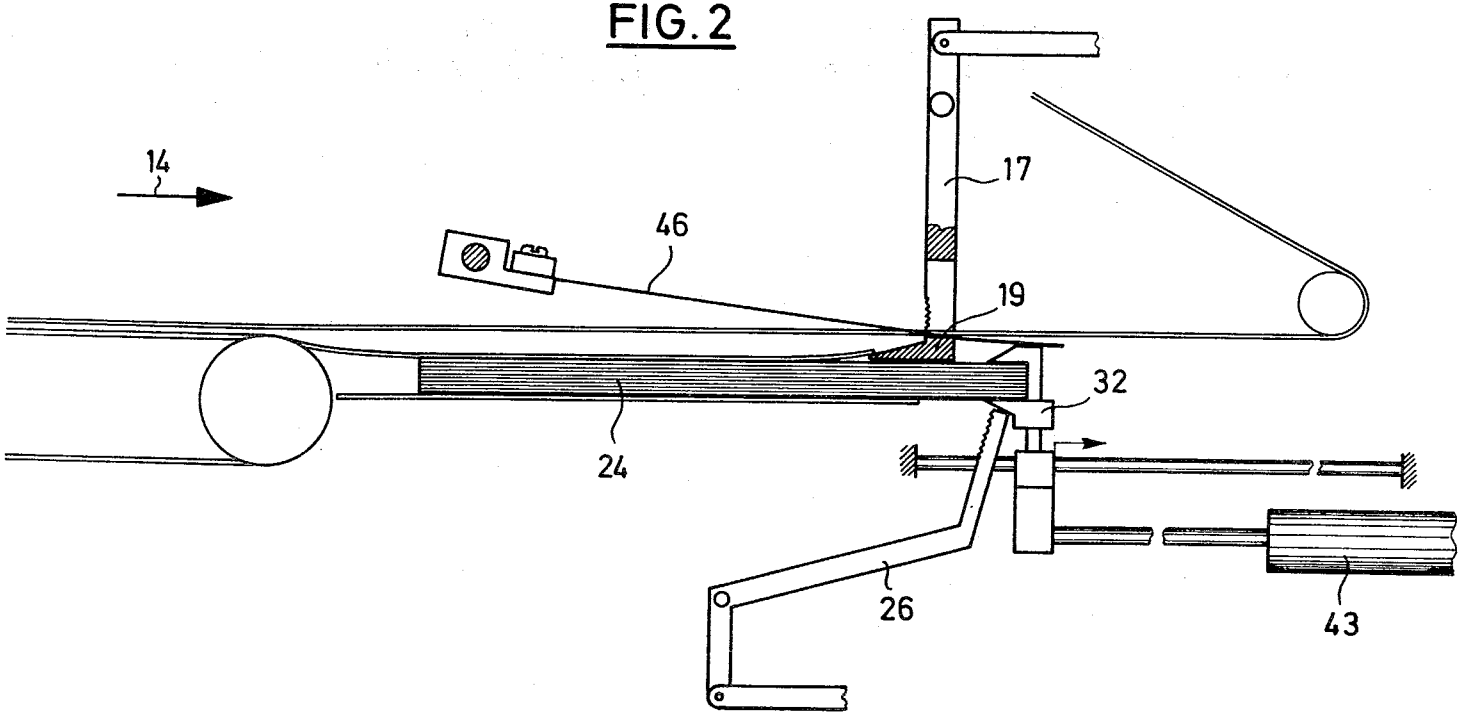

It may be seen from FIG. 2 that shortly after this operating position, the gripper 32 comes into action, being first advanced against the stack 24 by the pneumatic cylinder 43 and then closed and withdrawn in the direction of transport 14, the stack 26 moving under the foot 19 of the stop 17. The hold down device 46 and the hold down device 47 which until now has been lying either on the foot 19 or at the upper end of the stack, remain in position during this period.

Figure 3:
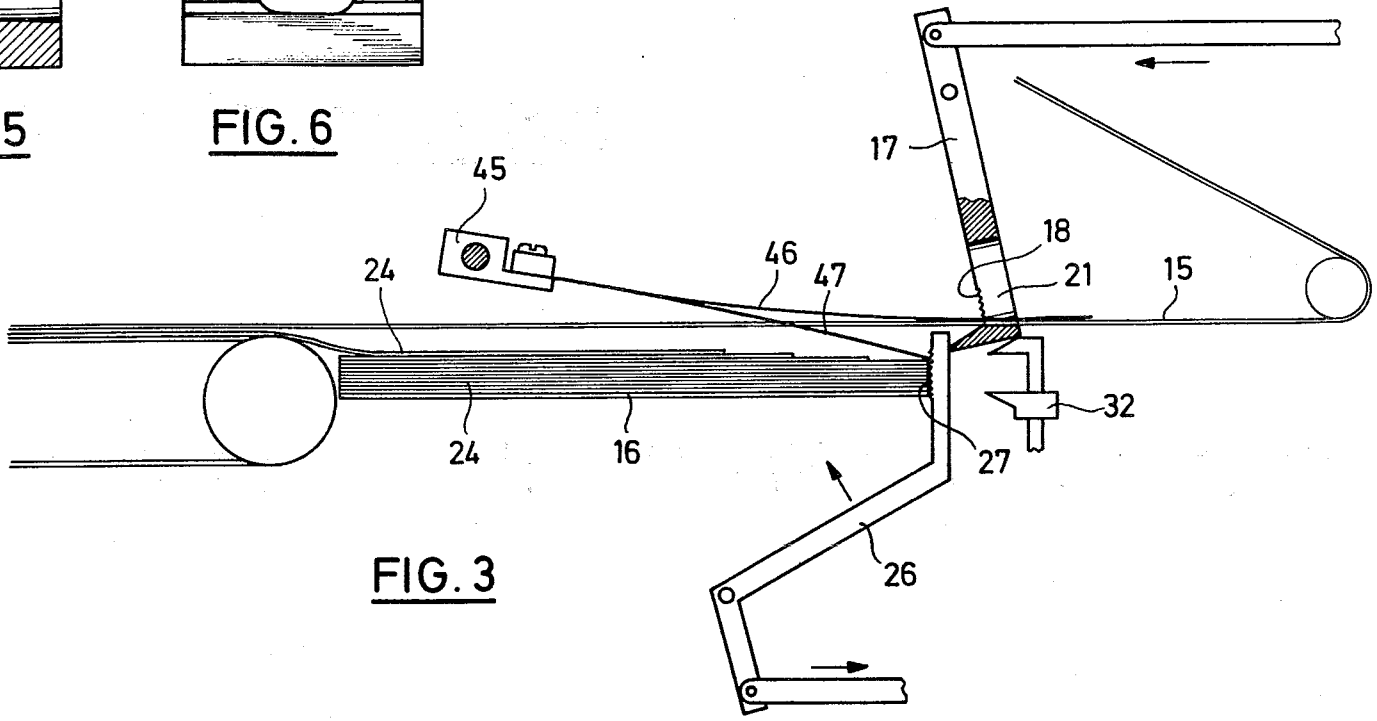

As shown in FIG. 3, after withdrawal of the previous stack 24, a new stack is deposited on the stacking table 16 by withdrawal of the stop 17. This is effected by rotation of the cam drum 42, which is followed by pivoting of the lever 36 in the anti-clockwise direction and consequently also, by way of the rod 34, pivoting of the stop 17 in this direction.

Prior to the introduction of the new stack, the lower stop 26 is moved with its stop surface 27 into a position to form a boundary to the rear edge of the stack. This anti-clockwise rotation, is effected by the same cam drum 42 causing anti-clockwise pivoting of the lever 37 which is transmitted to the stop 26 by the rod 35.

It may be seen that as the sheets 12 are deposited on the newly forming stack 24, they abut against the stop surface 27, and both the ridges and the shorter hold down device 47, which now lies on the forward edge of the stack, prevent the sheets from rising up and damaging this edge of the stack. The ridging may be relatively fine so as not to interfere with exact positioning of the forward edge of the stack. Further, the ridging may be replaced by some other adhering or slip preventing measures, for example, by providing a brush-like structure or a simple roughening of the surface or a sandpaper-like coating.

The operating position shown in FIG. 3 is then followed by that shown in FIG. 1. The hold down devices 46, 47 are preferably flexible but may also, or alternatively, be pivotal.

What is claimed is:

1. In an apparatus for depositing conveyed sheets in a stack at a stacking location, advancing sheets being stopped by means engaging the forward edges of the sheets, the improvement comprising:

substantially horizontally reciprocating means for withdrawing completed stacks of aligned sheets from the stacking location;

the stop means including an upwardly inclined guide surface for the forward edges of the sheets, in order to separate subsequently conveyed sheets from completed stacks; and, hold down means operatively associated with the stop means for limiting upward movement of the forward edges of the sheets as the forward edges abut the stop means.

2. An apparatus according to claim 1, wherein said hold down means is disposed on a sheet-edge-engaging surface of the stop means.

3. An apparatus according to claim 2, wherein said hold down means comprises a rough surface for engaging the forward edge of the sheets.

4. An apparatus according to claim 2, wherein said hold down means comprises an effective adhering surface with respect to the forward edges of the sheets.

5. An apparatus according to claim 3, wherein the hold down means comprises a plurality of ridges on the sheet-edge-engaging surface extending parallel to the planes of the stacked sheets.

6. An apparatus according to claim 2, comprising:

a first stop mounted for pivotal movement about an axis above said stacking location and being moveable between an inoperative position and an operative sheet-edge-engaging position adjacent the stacking location;

a second stop mounted for pivotal movement about an axis below said stacking location and being moveable between an inoperative position and an operative sheet-edge-engaging position adjacent the stacking location, and beneath the operative position of the first stop; and, the hold down means being disposed on each of the two stops.

7. An apparatus according to claim 1, wherein the hold down means comprises sheet-edge-engaging means disposed on the stop means and at least one flexible element located above and extending downwardly toward said stacking location.

8. An apparatus for depositing conveyed sheets in a stack at a stacking location, advancing sheets being stopped by means engaging forward edges of the sheets, the apparatus comprising:

upper and lower stops pivotally mounted for movement between operative sheet-edge-engaging positions adjacent the stacking location and inoperative positions; and, at least one pair of flexible hold down elements disposed above the stacking location and extending downwardly at an oblique angle, in the conveying direction, so as to prevent upward movement of the forward edges against the stops, each of the hold down elements being operatively associated with one of the upper and lower stops respectively, the upper stop limiting movement of its respective hold down element toward the stack in the operative position and throughout the pivotal movement.

9. An apparatus according to claim 8, wherein the flexible elements are pivotally mounted.

10. An apparatus according to claim 8, wherein the flexible elements are springy strips.

11. An apparatus according to claim 8, wherein the flexible elements are metal strips.

12. An apparatus according to claims 8 or 9, wherein the flexible element operatively associated with the upper stop extends through an opening formed in the upper stop.

13. An apparatus according to claims 8 or 9, wherein the flexible element operatively associated with the upper stop extends between the upper and lower stops.

14. An apparatus according to claims 8 or 9, wherein the flexible element operatively associated with the upper stop extends at least to a position adjacent the forward edges of the stacked sheets.

15. An apparatus for depositing conveyed sheets in a stack at a stacking location, advancing sheets being stopped by means engaging forward edges of the sheets, the apparatus comprising:

upper and lower stops pivotally mounted for movement between operative sheet-edge-engaging positions adjacent the stacking location and inoperative positions; and, at least one pair of hold down elements pivotally mounted above the stacking location and extending downwardly at an oblique angle, in the conveying direction, so as to prevent upward movement of the forward edges against the stops, each of the hold down elements being operatively associated with one of the upper and lower stops respectively, the upper stop limiting movement of its respective hold down element toward the stack in the operative position and throughout the pivotal movement.

16. An apparatus according to claim 15, wherein the flexible element operatively associated with the upper stop extends through an opening formed in the upper stop.

17. An apparatus according to claim 15, wherein the flexible element operatively associated with the upper stop extends between the upper and lower stops.

18. An apparatus according to claim 15, wherein the flexible element operatively associated with the upper stop extends at least to a position adjacent the forward edges of the stacked sheets.

19. An apparatus for depositing conveyed sheets in a stack at a stacking location, advancing sheets being stopped by means engaging forward edges of the sheets, the apparatus comprising:

substantially horizontally disposed conveying means for delivering the sheets to the stacking location;

stop means defining at least one abutment surface and thereby cooperating with the forwards edges of the sheets for forming aligned stacks, the stop means being mounted for pivotal movement between an operative sheet-edge-engaging position adjacent the stacking location and an inoperative position;

substantially horizontally reciprocating means for withdrawing completed stacks of aligned sheets from the stacking location;

inclined guiding means operatively associated with the stop means and providing an upwardly directed path to the stop means for the forward edges of the sheets, the path defining an obtuse angle relative to the at least one abutment surface, for separating subsequently conveyed sheets from completed stacks to enable removal of the completed stacks;

the at least one abutment surface provided with means for preventing upward movement of the forward edges of the sheets, notwithstanding the upwardly inclined guiding means; and, means for sequentially controlling the movement of the stop means and the reciprocating means to enable the completed stacks of aligned sheets to be withdrawn while subsequently conveyed sheets continue to be deposited.

20. An apparatus according to claim 19, wherein the at least one abutment surface is roughly textured.

21. An apparatus according to claim 19, wherein the at least one abutment surface is a non-skid surface.

22. An apparatus according to claim 19, wherein the at least one abutment surface is an effective adhering surface with respect to the forward edges of the sheets.

23. An apparatus according to claim 19, wherein the at least one abutment surface comprises a plurality of ridges defining downward deflection surfaces.

* * * * *